US012091204B2

(12) United States Patent
Lawson et al.

(10) Patent No.: US 12,091,204 B2
(45) Date of Patent: Sep. 17, 2024

(54) APPARATUS FOR SUPPORTING A LAUNDRY HAMPER AND A LAUNDRY HAMPER ASSEMBLY INCORPORATING SAME

(71) Applicant: Tag Hardware Systems Ltd., Surrey (CA)

(72) Inventors: Stephen Lawson, Surrey (CA); Stephen Campion, Surrey (CA)

(73) Assignee: Tag Hardware Systems Ltd., Surrey (CA)

( * ) Notice: Subject to any disclaimer, the term of this patent is extended or adjusted under 35 U.S.C. 154(b) by 141 days.

(21) Appl. No.: 17/718,691

(22) Filed: Apr. 12, 2022

(65) Prior Publication Data

US 2023/0322428 A1 Oct. 12, 2023

(51) Int. Cl.
*B65B 67/12* (2006.01)
*D06F 95/00* (2006.01)

(52) U.S. Cl.
CPC ..... *B65B 67/1216* (2013.01); *D06F 95/004* (2013.01)

(58) Field of Classification Search
CPC ..... B65B 67/12; B65B 67/1216; B65B 2067/1294; B62B 2202/66; B65F 1/141; B65F 1/1415; B65F 1/1426; D06F 95/004; D04F 95/002
See application file for complete search history.

(56) References Cited

U.S. PATENT DOCUMENTS

| | | | | | |
|---|---|---|---|---|---|
| 672,417 | A * | 4/1901 | Field | B65F 1/141 | 232/19 |
| 2,042,517 | A * | 6/1936 | Ellis | F25D 25/02 | 211/99 |
| 2,412,834 | A | 12/1946 | Roberts | | |
| 2,895,782 | A | 7/1959 | Fragale | | |
| 2,904,897 | A | 9/1959 | Whyte et al. | | |
| 3,218,014 | A | 11/1965 | Frazier | | |
| 3,726,211 | A | 4/1973 | Gladwin | | |
| 4,062,604 | A | 12/1977 | Popper | | |
| 4,196,880 | A * | 4/1980 | Hynes | B65B 67/12 | 312/4 |
| 4,238,868 | A * | 12/1980 | Sternberg | B65B 67/12 | 248/101 |
| 4,603,781 | A * | 8/1986 | Ryan, Jr. | A47F 5/01 | 211/90.04 |

(Continued)

FOREIGN PATENT DOCUMENTS

| | | |
|---|---|---|
| DE | 2344614 C3 | 9/1980 |
| GB | 1343549 A | 1/1974 |

(Continued)

*Primary Examiner* — Jonathan Liu
*Assistant Examiner* — Guang H Guan
(74) *Attorney, Agent, or Firm* — Oyen Wiggs Green & Mutala LLP

(57) ABSTRACT

An apparatus for supporting a laundry hamper is disclosed. The apparatus comprises a supporting rod having one or more sides arranged to form a closed frame, one or more mounting brackets, and means for securing the one or more mounting brackets to a door of a cabinet, such as a tilt-out cabinet. Aspects of the invention relate to a laundry hamper assembly comprising the apparatus and at least one laundry hamper being supported thereon.

19 Claims, 5 Drawing Sheets

(56) References Cited

U.S. PATENT DOCUMENTS 4,997,147 A * 3/1991 Velke, Sr. ..... F16L 3/1215 248/50
5,058,838 A * 10/1991 Velke, Sr. ..... H02B 1/202 248/50
5,125,605 A 6/1992 Guerrera
5,356,001 A * 10/1994 Luna ..... A63B 63/083 248/101
D367,139 S * 2/1996 Brown ..... D34/5
5,852,883 A 12/1998 Ziglar et al.
6,409,131 B1 * 6/2002 Bentley ..... A61M 5/1415 248/230.1
6,488,241 B1 12/2002 Kyte et al.
6,517,033 B2 * 2/2003 Russell ..... B65B 67/1227 248/101
7,210,659 B2 * 5/2007 Lawson ..... D06F 95/004 211/94.01
7,240,803 B2 * 7/2007 Stitchick ..... A47B 96/061 211/90.03
7,243,884 B2 7/2007 Lawson et al.
8,640,890 B2 * 2/2014 Schiller ..... F16B 47/00 211/85.15
8,910,813 B1 12/2014 Barre et al.
11,027,915 B2 * 6/2021 Rana ..... B65F 1/1415
11,690,951 B1 * 7/2023 Hartman ..... A61M 5/1415 604/508
2003/0057171 A1 * 3/2003 Wang ..... A47B 43/00 211/85.15
2006/0157358 A1 7/2006 Heidel
2015/0097091 A1 * 4/2015 Felsenthal ..... B65F 1/1468 248/97
2018/0335177 A1 * 11/2018 Black ..... F16M 13/022
2023/0322428 A1 * 10/2023 Lawson ..... B65B 67/1216 248/95

FOREIGN PATENT DOCUMENTS

JP 5187133 B2 4/2013
WO 2008154740 A1 12/2008

* cited by examiner

APPARATUS FOR SUPPORTING A LAUNDRY HAMPER AND A LAUNDRY HAMPER ASSEMBLY INCORPORATING SAME

FIELD OF THE INVENTION

The invention pertains to apparatuses for supporting a laundry hamper, more particularly those of the type that are mountable to a cabinet door.

BACKGROUND

Although laundry hampers are known in the art, it remains desirable to provide a laundry hamper that is lightweight, compact, collapsible, and easy to install. The present invention is directed to an improved apparatus for supporting a laundry hamper and a laundry hamper assembly which incorporates the apparatus, and more particularly, a laundry hamper assembly that may be adapted for use in a tilt-out cabinet.

SUMMARY

The invention provides an apparatus for supporting a laundry hamper. The apparatus may be mountable to a door of a cabinet. In some embodiments, the cabinet is a tilt-out cabinet with the door being hinged to a bottom of the cabinet. The apparatus comprises a supporting rod arranged to form a closed frame. The supporting rod comprises one or more rods. The closed frame may have a rectangular shape. The apparatus also comprises one or more mounting brackets. Each of the mounting brackets comprises a channel with a recess within which a portion of the supporting rod is inserted therein. The channel comprises a first channel segment and a second channel segment separated by a gap. Each of the first channel segment and second channel segment comprises a first side wall and an opposing second side wall integral with a bottom wall to define a generally U-shaped structure. The bottom wall of the first channel segment faces a side opposite from the side at which the bottom wall of the second channel segment faces. The mounting bracket may further comprise a guiding wall projecting from a first end of the channel, arranged to surround at least a portion of a perimeter of the supporting rod. Means are provided to secure the mounting bracket to a door of a cabinet. Such means may for example be a fastener.

In example embodiments, the supporting rod is arranged to form a first side, a second side arranged spaced-apart from, and parallel to the first side, a third side, and a fourth side arranged spaced-apart from, and parallel to the third side. The third and fourth sides are arranged to join the first side to the third side at opposing ends thereof. In such embodiments, the apparatus comprises a first mounting bracket and a second mounting bracket. The first mounting bracket comprises a channel to receive a portion of a longitudinal length of the third side. The second mounting bracket comprises a channel arranged to receive a longitudinal portion of the fourth side. The first mounting bracket comprises a guiding wall projecting from a first end of the channel, arranged to surround a portion of a perimeter of the first side at a first end thereof. The second mounting bracket comprises a guiding wall projecting from a first end of the channel, arranged to surround a portion of a perimeter of the first side at a second end thereof.

In some embodiments, the mounting bracket comprises a first arm extending from a first end which is joined to the first end of the channel to an opposing second end, and a second arm joining a second end of the channel to the second end of the first arm. In some embodiments, the channel, first arm and second arm of the mounting bracket are arranged to form a generally triangular shape, and in some embodiments, a right triangle. In some embodiments, the mounting bracket comprises opposing attachment points projecting from each end of the first arm. Each of the attachment points is arranged to receive a fastener for securing the frame to a door of a cabinet.

The invention also provides a laundry hamper assembly comprising the apparatus for supporting a laundry hamper and at least one laundry hamper being supported thereon. The laundry hamper comprises an open top end, an opposing closed bottom end, and one or more side walls extending between the open top end and the closed bottom end. In example embodiments, one or more couplers project from the open top end for securing the laundry hamper to the apparatus. In some embodiments, two pairs of couplers are arranged to project from the open top end at opposing sides thereof. Each of the pairs of couplers are arranged spaced-apart along the same side. In some embodiments, a pair of handles project from opposing sides of the open top end, arranged to facilitate transport of the laundry hamper.

Further aspects of the invention and features of specific embodiments of the invention are described below.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DETAILED DESCRIPTION

Figures 1A, 1B:
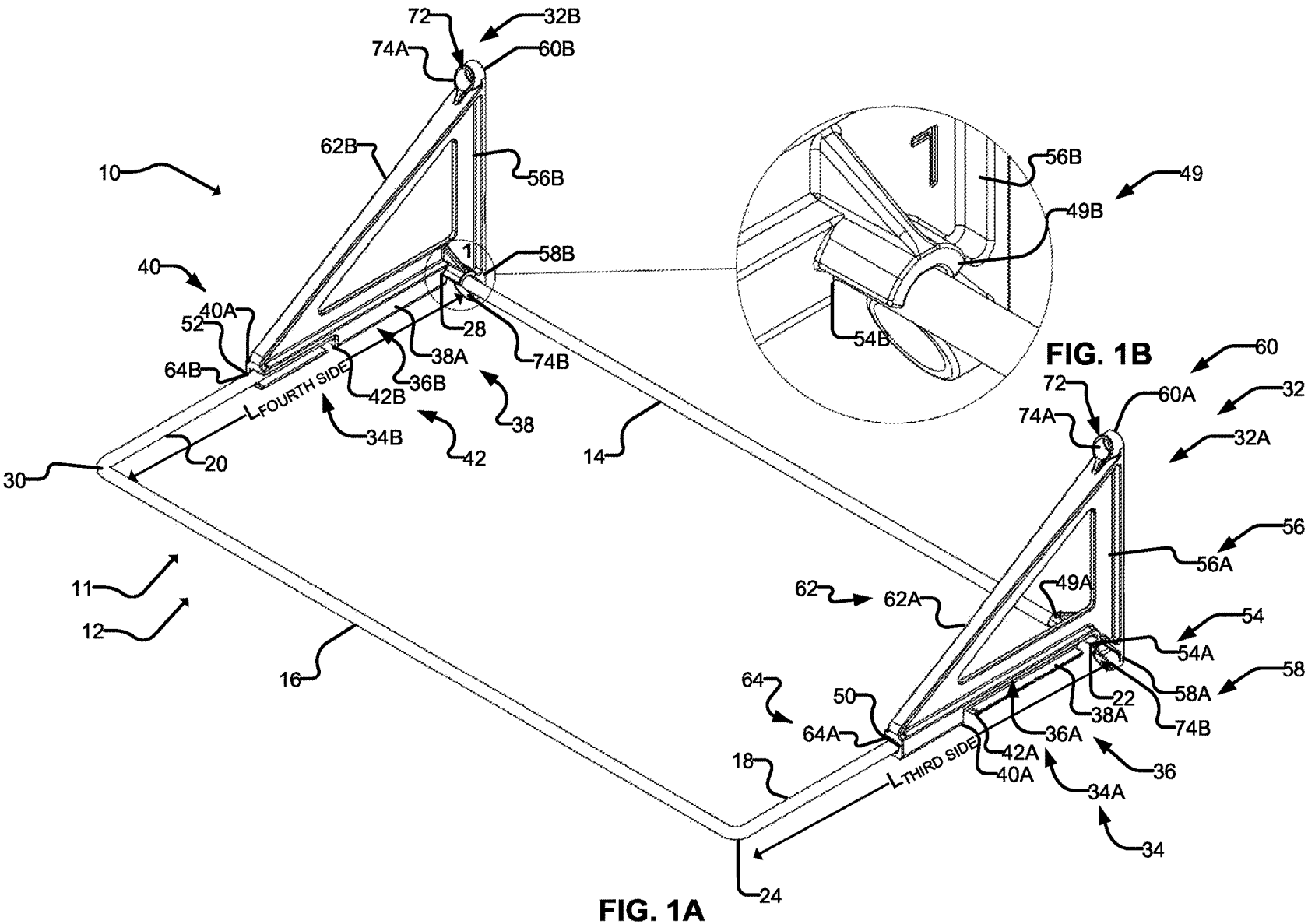
FIG. 1A is a perspective view of an apparatus for supporting a laundry hamper according to an example embodiment.
FIG. 1B is an enlarged partial view of the area indicated by the circle in FIG. 1A.

Referring to FIGS. 1A, 1B, 2 and 3, in one embodiment, the apparatus of the invention is an apparatus for supporting a laundry hamper. As used herein, the term "laundry hamper" means any suitable receptacle used for storing clothes, including but not limited to baskets, bags, boxes and sacks that are made of any suitable materials. The apparatus is mountable to a door of a cabinet. In some embodiments, the cabinet is a tilt-out cabinet with the door being hinged to a bottom of the cabinet.

The apparatus 10 comprises a supporting rod 11 arranged to form a frame 12. In some embodiments, the frame 12 is closed, i.e., the supporting rod 11 is made of one or more rods with the ends thereof being linked together. In some embodiments, the supporting rod 11 is arranged side to form a polygonal shape. In an example embodiment, the polygonal shape is a quadrilateral, including but not limited to a rectangle, square, rhombus, trapezium, parallelogram, etc.

In the illustrated embodiments, the supporting rod 11 is arranged to form a substantially rectangular shape. The supporting rod 11 comprises a first side 14, a second side 16 arranged spaced-apart from, and parallel to, the first side 14, a third side 18, and a fourth side 20 arranged spaced-apart from, and parallel to, the third side 18. The third side 18 joins a first end 22 of the first side 14 to a first end 24 of the second side 16. The fourth side 20 joins an opposing second end 28 of the first side 14 to an opposing second end 30 of the second side 16.

In some embodiments, the frame 12 is integrally formed. For example, the first, second, third and fourth sides 14, 16, 18, 20 are integrally formed by for example welding the ends thereof. In some embodiments, the supporting side 11 may be bent to form a square-shaped frame 12 with sides 14, 16, 18, 20. In other embodiments, the frame 12 is formed by interconnecting one or more rods to form the sides 14, 16, 18, 20.

The frame 12 may be made of any suitable material or a combination of materials, e.g., one or more of metal and alloys, plastic and wood. First, second, third, fourth sides 14, 16, 18, 20 may comprise a circular cross-sectional area and/or a non-circular cross-sectional area such as a square, rectangle, etc.

The apparatus 10 includes at least one mounting bracket 32. Each of the at least one mounting bracket 32 comprises a channel 34 with a recess 36 within which at least a portion of a longitudinal length of the supporting rod 11 is receivable therein. In the illustrated embodiments, the at least one mounting bracket 32 includes a pair of mounting brackets, a first mounting bracket 32A and a second mounting bracket 32B. The first mounting bracket 32A has a first channel 34A with a first recess 36A within which at least a portion of a longitudinal length of the third side 18 ($L_{THIRD\ SIDE}$) is received therein. The first channel 34A extends from the first end 22 of the first side 14 to a point 50 along the third side 18. The second mounting bracket 32B has a second channel 34B with a second recess 36B within which at least a portion of a longitudinal length of the fourth side 20 ($L_{FOURTH\ SIDE}$) is received therein. The second channel 34B extends from the second end 28 of the first side 14 to a point 52 along the fourth side 20.

In some embodiments, the portions of the longitudinal lengths of the third side 18 and fourth side 20 ($L_{THIRD\ SIDE}$, $L_{FOURTH\ SIDE}$) which are received within the respective first and second recesses 36A, 36B are between about ¼ and about ¾ of the entire longitudinal lengths of the third side 18 and fourth side 20 ($L_{THIRD\ SIDE}$, $L_{FOURTH\ SIDE}$), and in some embodiments, between about ⅓ and about ⅔ of the entire longitudinal lengths of the third side 18 and fourth side 20 ($L_{THIRD\ SIDE}$, $L_{FOURTH\ SIDE}$).

Figure 2:
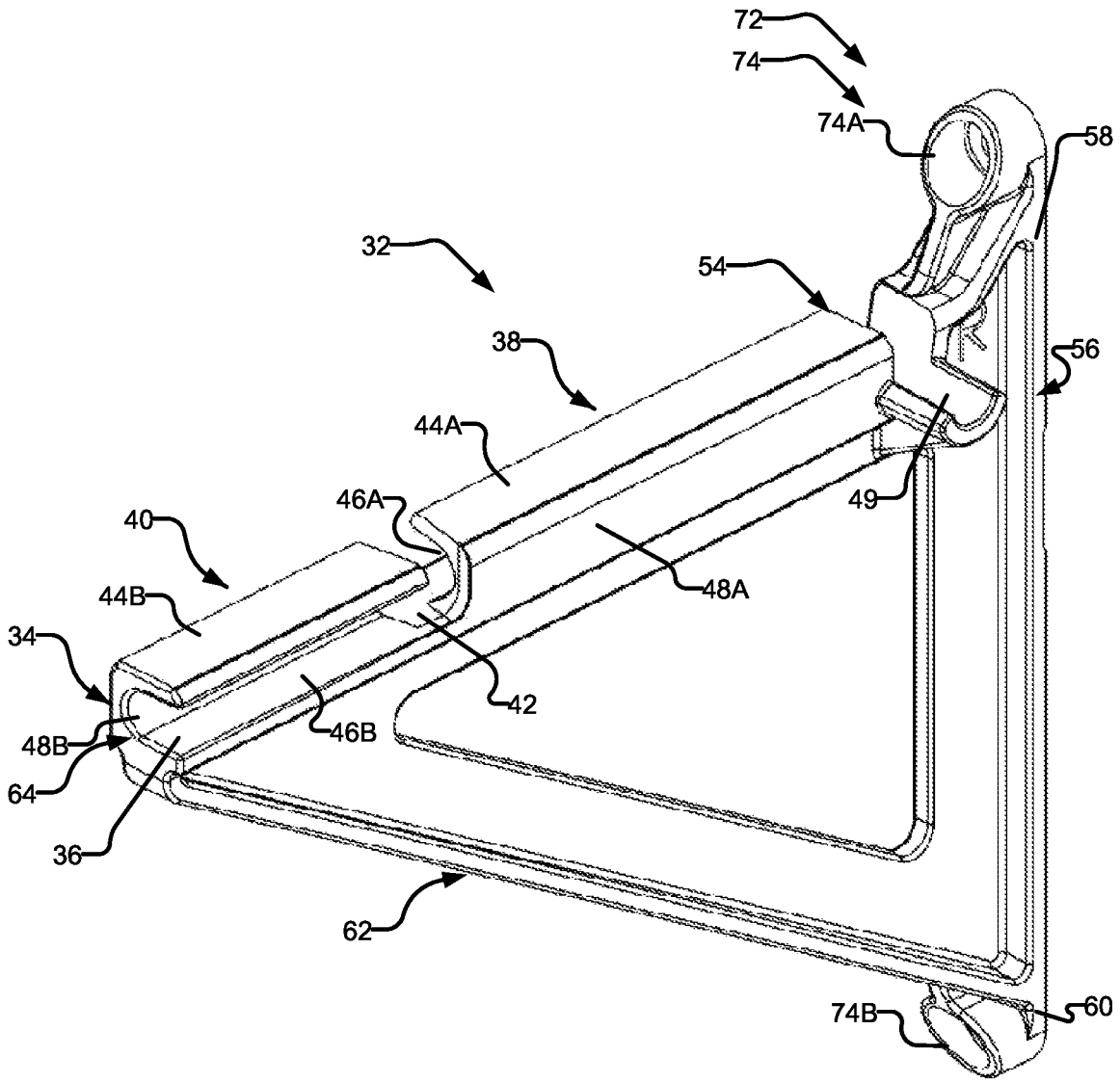
FIG. 2 is a perspective view of a mounting bracket of the apparatus of FIG. 1.
Figure 3:
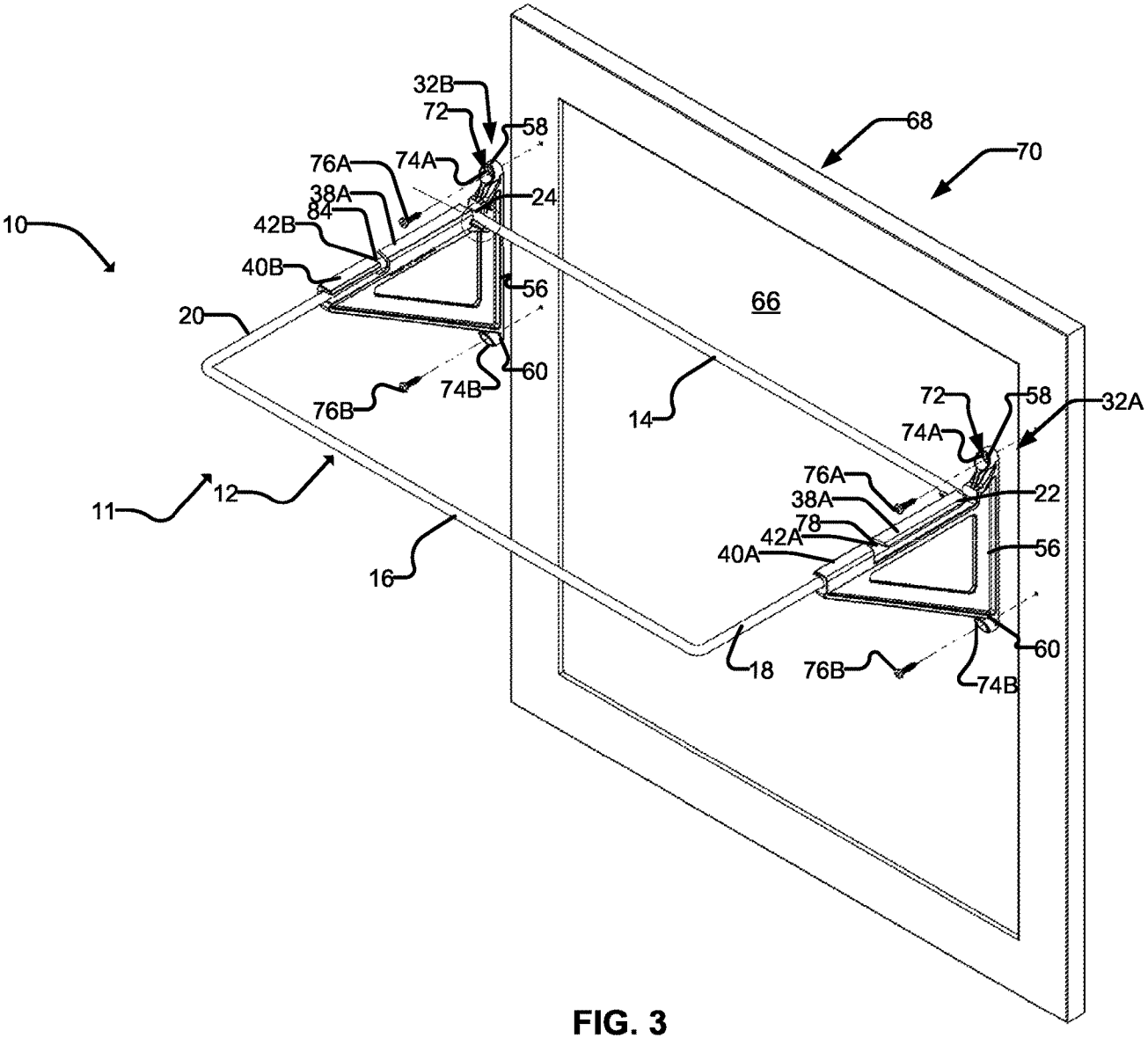
FIG. 3 is a perspective view of the apparatus of FIG. 1 and a door of a cabinet, showing an example means of attaching the apparatus to the door.

As best illustrated in FIG. 2, each of the channels 34 may comprise a first channel segment 38 and a second channel segment 40 separated by a gap 42. The first and second channel segments 38, 40 each comprises a first side wall 44A, 44B, a respective opposing second side wall 46A, 46B integral with a respective bottom wall 48A, 48B joining the first and second side walls 44A, 44B, 46A, 46B to define a generally U-shaped structure. In some embodiments, the bottom walls 48A, 48B of the first and second channel segments 38, 40 face opposite sides of the longitudinal axis of the channel 34. The opposite facing bottom walls 48A, 48B, in conjunction with the gap 42, facilitate the insertion of the third and fourth sides 18, 20 into the respective recesses 36A, 36B of the channels 34A, 34B of the mounting brackets 32A, 32B.

The first and second channel segments 38, 40 may have equal or different longitudinal lengths. In some embodiments, the first channel segment 38 has a longitudinal length greater than a longitudinal length of the second channel segment 40.

In some embodiments, each of the mounting brackets 32 further comprises a guiding wall 49 projecting outwardly from a first end 54 of the channel 34. The guiding wall 49 may be arranged to contact the supporting rod 11 to facilitate proper alignment of the bracket 32 with respect to the frame 12 and/or provide support of the supporting rod 11 to the mounting bracket 32 and/or provide a stop to control the rotation of the bracket 32 during assembly. In the illustrated embodiments, the guiding wall 49A of the first mounting bracket 32A projects from the first end 54A of the channel 34A arranged to contact a portion of a longitudinal length extending from the first end 22 of the first side 14. Similarly, the guiding wall 49B of the second mounting bracket 32B projects from the first end 54B of the channel 34B arranged to contact a portion of a longitudinal length extending from the second end 28 of the first side 14. In some embodiments, the guiding wall 49 comprises a convex, curved shape. In some embodiments, the guiding wall 49 surrounds at least a portion of a perimeter of the first side 14.

Each of the mounting brackets 32 may further comprise a first arm 56 projecting outwardly from the first end 54 of the channel 34. The first arm 56 may project orthogonal to the longitudinal axis of the channel 34. The first arm 56 and the channel 34 may be arranged to define a right angle (90°) therebetween. The first arm 56 may extend from a first end 58 of the first arm 56, which may be joined to the first end 54 of the channel 34, to an opposing second end 60 thereof. In some embodiments, the mounting bracket 32 may further comprise a second arm 62. The second arm 62 extends to join a second end 64 of the channel 34, opposite to the first end 54 thereof, to the second end 60 of the first arm 56. In some embodiments, the channel 34, first arm 56 and second arm 62 are arranged to form a generally triangular shape, and in some embodiments, a right triangle.

The mounting bracket 32 may be made of any suitable materials, including but not limited to, metals and alloys, plastic, wood or a combination thereof. In some embodiments, the mounting bracket 32 is made of a composite material. Non-limiting examples of suitable composite materials include reinforced plastics, metal matrix composites, composite wood, fiberglass, composite ceramic, carbon fiber, etc.

Means are provided to secure the mounting bracket 32 to a face 66 of a door 68 of a cabinet 70. Such means may include any suitable fastener including for example screw, bolt, rivet, adhesive tape, and hook and loop. Each of the mounting brackets 32 may include one or more attachment points to engage with a fastener. In example embodiments, the one or more attachment points 72 each comprises a slot opening 74. The slot opening 74 may be arranged at any suitable position along the mounting bracket 32. In the illustrated embodiments, a pair of slot openings 74A, 74B are arranged to project from each end 58, 60 of the first arm 56 of the mounting bracket 32. A pair fasteners 76A, 76B such as a screw may each be inserted through the slot openings 74A, 74B, and to the face 66 of the door 68 so as to secure the mounting bracket 32 to the door 68.

In some embodiments, the cabinet 70 is a tilt-out cabinet with the door 68 being hinged to a bottom of the cabinet 70. In such embodiments, the frame 12 may be arranged laterally from the face 66 of the door 68. In some embodiments, the frame 12 is arranged orthogonal from the face 66 of the door 68.

The frame 12 is attachable to the mounting bracket 32 by inserting a first portion of the supporting rod 11 into the gap 42, and turning the supporting rod 11 so as to align for insertion of opposing portions that are adjacent to the first portion of the supporting rod 11 into the recess 36 of the channel 34. The opposing portions are inserted within the recesses of the first channel segment 38 and the second channel segment 40 respectively. The guiding wall 49 is then arranged to surround a portion of the perimeter of the supporting rod 11. In one example, the frame 12 is attachable to two mounting brackets 32, the first mounting bracket 32A and the second mounting bracket 32B. A first portion 78 of the third side 18 is inserted into the gap 42A of the channel 34A between the first channel segment 38A and the second channel segment 40A. The mounting bracket 32A is positioned, e.g., by turning, to align opposing sections that are adjacent to the first portion 78 of the third side 18 to be received within the respective first channel segment 38A and second channel segment 40A. The mounting bracket 32A is then positioned to align the guiding wall 49A to surround at least a portion of a perimeter of the first side 14 at the first end 22 thereof. The same steps are repeated to attach the supporting rod 11 to the mounting bracket 32B. A first portion 84 of the fourth side 20 is inserted into the gap 42B of the channel 34B between the first channel segment 38B and the second channel segment 40B. The mounting bracket 32B is positioned, e.g., by turning, to align opposing sections that are adjacent to the first portion 84 of the fourth side 20 to be received within the respective first channel segment 38B and second channel segment 40B. The mounting bracket 32B is then positioned to align the guiding wall 49B to surround at least a portion of a perimeter of the first side 14 at the second end 24 thereof.

The frame 12 may be attachable to the mounting bracket 32 without using any hand or power tools, advantageously allowing for easy installation and transport for both the suppliers and the end users. For example, a plurality of frames 12 may be stacked on top of one another during transport, while the mounting brackets 32 may be separately stored.

Figure 4:
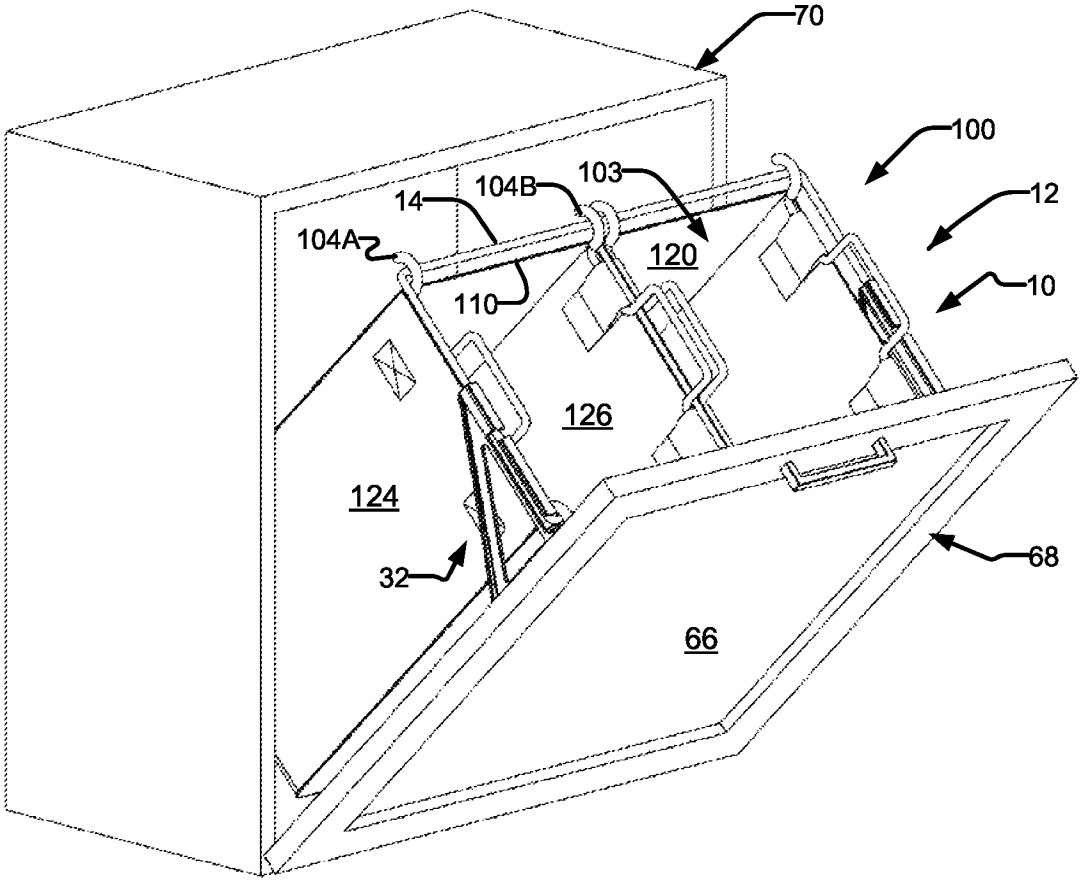
FIG. 4 is a perspective view of a laundry hamper assembly affixed to a door of a tilt-out cabinet, the laundry hamper assembly comprising the apparatus of FIG. 1 according to an example embodiment.
Figure 5:
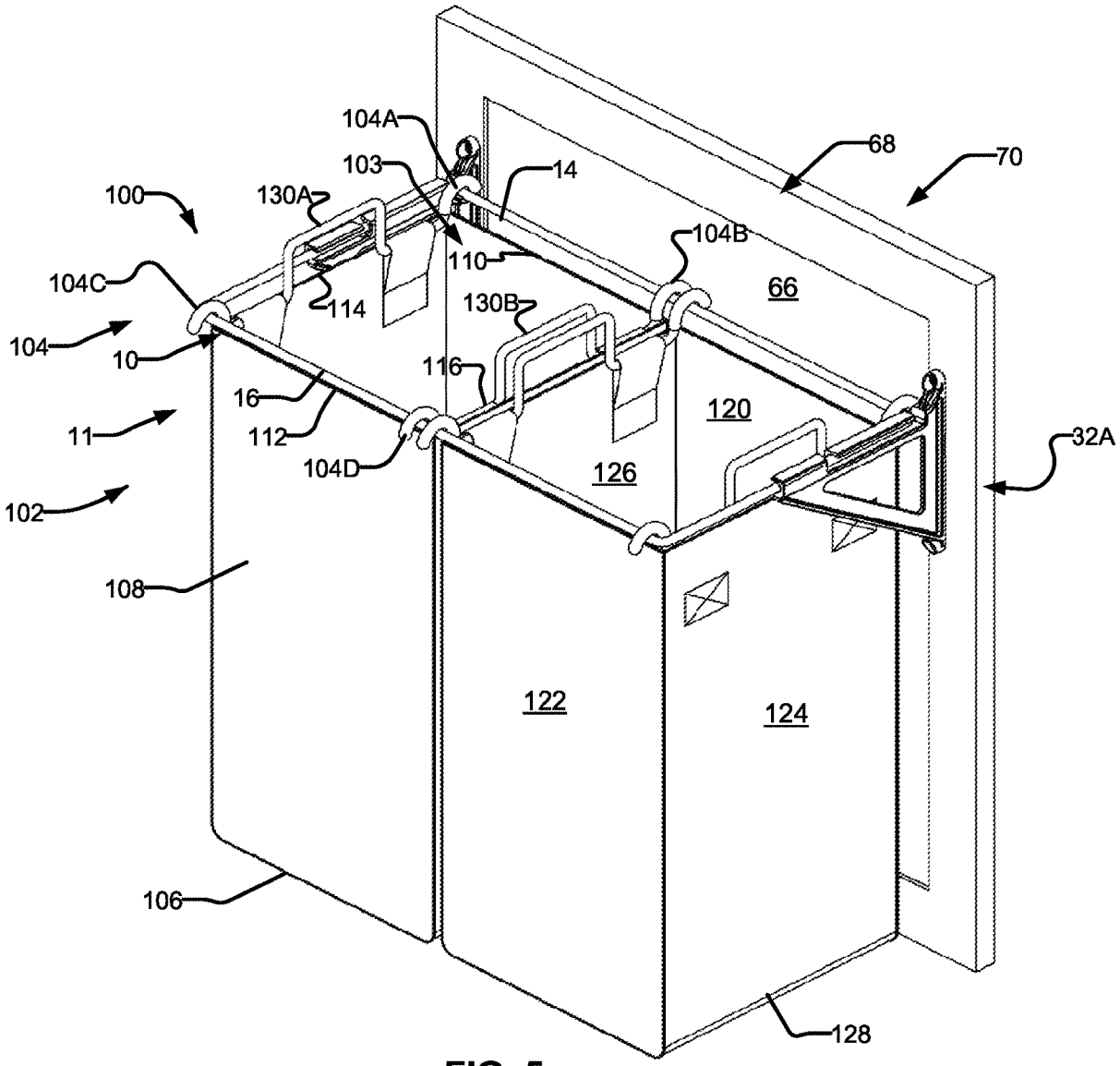
FIG. 5 is a perspective view of the laundry hamper assembly of FIG. 4, showing the laundry hamper assembly affixed to the door without the tilt-out cabinet.

Aspects of the invention comprises a laundry hamper assembly 100. Referring to FIGS. 4 and 5, the laundry hamper assembly 100 includes the apparatus for supporting a an apparatus 10 and one or more laundry hampers 102 arranged to be supported on the apparatus 10. The apparatus 10 may be sized to support any number of laundry hampers 102, for example by adjusting the longitudinal length of the first and second sides 14, 16.

In some embodiments, the laundry hamper 102 comprises an open top end 103 and an opposing closed bottom end 106 with one or more side walls 108 extending between the top and bottom ends 103, 106. In some embodiments, a lid (not shown) may be arranged to cover the open top end 103. At least one coupler 104 projects outwardly from the open top end 103, arranged to engage a portion of the supporting rod 11, in order to secure the laundry hamper 102 to the apparatus 10. A non-limiting example of a suitable coupler 104 is a coupling hook.

In the illustrated embodiments, the open top end 103 of the laundry hamper 102 comprises a first side 110, a second side 112 arranged spaced-apart and parallel to the first side 110, a third side 114, and a fourth side 116 arranged spaced-apart and parallel to the third side 114, the third and fourth sides 114, 116 connecting the first side 110 to the second side 112. In the illustrated embodiments, four couplers 104 are arranged to project from the open top end 103 of the laundry hamper 102. The four couplers 104 comprise a first pair of spaced-apart couplers 104A, 104B arranged to project from the first side 110, and a second pair of spaced-apart couplers 104C, 104D arranged to project from the second side 112. The first pair of spaced-apart couplers 104A, 104B are arranged to engage with the first side 14, and the second pair of spaced-apart couplers 104C, 104D are arranged to engage with the second side 16 so as to secure the laundry hamper 102 to the apparatus 10.

The laundry hamper 102 may comprise any suitable shape for storing clothes. In example embodiments, the laundry hamper 102 comprises a first panel 120, an opposing second panel 122 arranged spaced-apart from the first panel 120, a third panel 124, an opposing fourth panel 126 arranged spaced-apart from the third panel 124, and a bottom panel 128 extending along a side of the first, second, third and fourth panels 120, 122, 124, 126 to form the closed bottom end 106. The third and fourth panels 124, 126 are arranged to extend between the first and second panels 120, 122. In some embodiments, the panels 120, 122, 124, 126, 128 have a rectangular shape. However, this is not mandatory. The panels 120, 122, 124, 126, 128 may have other polygonal shapes, such as square, and other quadrilateral shapes.

The laundry hamper 102 may further include a pair of handles 130A, 130B projecting from the open top end 103 thereof, arranged to facilitate the removing of the laundry hamper 102 from the apparatus 10 and/or the installing of the laundry hamper 102 to the apparatus 10 and/or the transporting of the laundry hamper 102. In some embodiments, the pair of handles 130A, 130B are arranged to project from opposing sides of the open top end 104, and at sides that do not comprise the coupler 104. In the illustrated embodiments, the pair of handles 130A, 130B are arranged to project from the third and fourth sides 114, 116 of the open top end 103 respectively.

In use, the laundry hamper 102 is supported on the apparatus 10, which the apparatus 10 has been affixed to the door 68 of the cabinet 70, by coupling the one or more couplers 104 to the supporting rod 11, such as by securing a hook 104 to the supporting rod 11. The laundry hamper 102 may be removed from the apparatus 10 by disengaging the one or more couplers 104 from the supporting rod 11.

Throughout the foregoing description and the drawings, in which corresponding and like parts are identified by the same reference characters, specific details have been set forth in order to provide a more thorough understanding to persons skilled in the art. However, well known elements may not have been shown or described in detail or at all to avoid unnecessarily obscuring the disclosure.

As will be apparent to those skilled in the art in the light of the foregoing disclosure, many alterations and modifications are possible in the practice of this invention without departing from the scope thereof. Accordingly, the description and drawings are to be regarded in an illustrative, rather than a restrictive, sense.

The invention claimed is:

1. An apparatus (10) for supporting a laundry hamper, comprising:

a supporting rod (11) arranged to form a closed frame (12);

one or more mounting brackets (32); and means (76A, 76B) for securing the one or more mounting brackets to a door (68) of a cabinet (70), each mounting bracket having:

a channel (34) with a recess (36) to receive at least a portion of the supporting rod therein, wherein the channel comprises a first channel segment (38) and a second channel segment (40) separated from the first channel segment by a gap (42), wherein the first and second channel segments each comprise a first side wall (44A, 44B), an opposing second side wall (46A, 46B) and a bottom wall (48A, 48B) integral with the first and second side walls to define a generally U-shaped structure, and wherein the bottom wall of the first channel segment and the bottom wall of the second channel segment face opposite sides of a longitudinal axis of the channel.

2. The apparatus according to claim 1, wherein the supporting rod comprises a first side (14) and a second side (16) arranged spaced-apart from the first side, a third side (18) and a fourth side (20) arranged spaced-apart from the third side, the third and fourth sides joining the first side to the second side at opposing ends (22, 24, 28, 30) of the first and second sides.

3. The apparatus according to claim 2, wherein the one or more mounting brackets comprise a pair of mounting brackets (32A, 32B), wherein at least a portion of each of the third and fourth sides is received within a respective recess of the recesses (36A, 36B) of the channels (34A, 34B) of the pair of mounting brackets.

4. The apparatus according to claim 2, wherein the first side is arranged parallel to the second side, and the third side is arranged parallel to the fourth side.

5. The apparatus according to claim 4, wherein the first, second, third and fourth sides are arranged on a same plane.

6. The apparatus according to claim 1, wherein each mounting bracket further comprises:

a first arm (56) extending from a first end (58) of the first arm to an opposing second end (60) of the first arm in a direction orthogonal to the longitudinal axis of the channel, wherein the first end of the first arm joins a first end (54) of the channel; and a second arm (62) extending to join a second end (64) of the channel to the second end of the first arm.

7. The apparatus according to claim 6, wherein the first arm of each mounting bracket terminates with one or more attachment points (72) each arranged at a respective end of the first and second ends for engaging with a respective fastener (76A, 76B).

8. The apparatus according to claim 7, wherein each attachment point of the first arm of each mounting bracket comprises a slot opening (74) to allow the respective fastener to be inserted therethrough.

9. The apparatus according to claim 1, wherein a length of each of the first and second sides of the supporting rod is greater than a length of each of the third and fourth sides of the supporting rod.

10. A laundry hamper assembly (100), comprising:

an apparatus for supporting a laundry hamper according to claim 1;

at least one laundry hamper (102) having an open top end (103), an opposing closed bottom end (106) and a side wall (108) extending between the open top end and the closed bottom end; and at least one coupler (104) coupleable to a first side of the supporting rod of the apparatus and/or a second side of the supporting rod of the apparatus, wherein the at least one coupler is arranged to project outwardly from the open top end of the at least one laundry hamper.

11. The laundry hamper assembly according to claim 10, wherein the at least one coupler comprises a first coupler (104A) and a second coupler (104C) coupleable to the first and second sides of the supporting rod of the apparatus respectively, wherein the first and second couplers are arranged to project outwardly from the open top end of the at least one laundry hamper at opposing sides thereof.

12. The laundry hamper assembly according to claim 10, wherein the at least one coupler comprises a pair of spaced-apart first couplers (104A, 104B) and a pair of spaced-apart second couplers (104C, 104D) coupleable to the first and second sides of the supporting rod of the apparatus respectively, wherein the first and second couplers are arranged to project outwardly from the open top end of the at least one laundry hamper at opposing sides thereof.

13. The laundry hamper assembly according to claim 10, further comprising a pair of handles (130A, 130B) arranged to project outwardly from the open top end of the at least one laundry hamper at opposing sides thereof.

14. The laundry hamper assembly according to claim 10, wherein the side wall of the at least one laundry hamper comprises a first panel (120) and an opposing second panel (122) arranged spaced-apart from the first panel, a third panel (124) and an opposing fourth panel (126) arranged spaced-apart from the third panel, the third and fourth panels connecting the first and second panels, and wherein the at least one laundry hamper further comprises a bottom panel (128) forming the closed bottom end.

15. An apparatus (10) for supporting a laundry hamper, comprising:

a supporting rod (11) arranged to form a closed frame (12);

a plurality of mounting brackets (32), each mounting bracket having a channel (34) with a recess (36) to receive at least a portion of the supporting rod therein; and means (76A, 76B) for securing the plurality of mounting brackets to a door (68) of a cabinet (70), wherein the supporting rod comprises a first side (14) and a second side (16) arranged spaced-apart from the first side, a third side (18) and a fourth side (20) arranged spaced-apart from the third side, the third and fourth sides joining the first side to the second side at opposing ends (22, 24, 28, 30) of the first and second sides, wherein the plurality of mounting brackets comprise a pair of mounting brackets (32A, 32B), wherein at least a portion of each of the third and fourth sides is received within a respective recess of the recesses (36A, 36B) of the channels (34A, 34B) of the pair of mounting brackets, wherein each mounting bracket of the pair of mounting brackets further comprises a guiding wall (49) projecting outwardly from a first end (54) of the respective channel and arranged to contact at least a section of the first side or at least a section of the second side.

16. The apparatus according to claim 15, wherein the channel of each mounting bracket of the pair of mounting brackets comprises a first channel segment (38) and a second channel segment (40) separated from the first channel segment by a gap (42).

17. The apparatus according to claim 16, wherein each of the first and second channel segments of the channel of each mounting bracket of the pair of mounting brackets comprises a first side wall (44A, 44B), an opposing second side wall (46A, 46B) and a bottom wall (48A, 48B) integral with the first and second side walls to define a generally U-shaped structure.

18. The apparatus according to claim 15, wherein each guiding wall projects laterally from a longitudinal axis of the respective channel.

19. The apparatus according to claim 15, wherein each guiding wall comprises a convex, curved surface.

* * * * *